US005641928A

United States Patent [19]

Tohgi et al.

[11] Patent Number: 5,641,928

[45] Date of Patent: Jun. 24, 1997

[54] MUSICAL INSTRUMENT HAVING A CHORD DETECTING FUNCTION

[75] Inventors: Yutaka Tohgi; Yoshiko Fukushima, both of Hamamatsu, Japan

[73] Assignee: Yamaha Corporation, Japan

[21] Appl. No.: 270,457

[22] Filed: Jul. 5, 1994

[30] Foreign Application Priority Data

Jul. 7, 1993 [JP] Japan ..... 5-191833
Aug. 26, 1993 [JP] Japan ..... 5-234235

[51] Int. Cl.[6] ..... G10H 1/38

[52] U.S. Cl. ..... 84/613; 84/637; 84/669

[58] Field of Search ..... 84/613, 637, 650, 84/669, DIG. 22

[56] References Cited

U.S. PATENT DOCUMENTS

| | | | |
|---|---|---|---|
| 4,381,689 | 5/1983 | Oya | 84/1.01 |
| 4,499,807 | 2/1985 | Ishida | 84/1.03 |
| 4,646,609 | 3/1987 | Teruo et al. | 84/1.01 |
| 5,056,401 | 10/1991 | Yamaguchi et al. | 84/635 |
| 5,069,104 | 12/1991 | Shibukawa | 84/478 |
| 5,179,557 | 1/1993 | Kudo | 370/94.1 |
| 5,202,528 | 4/1993 | Iwaooji | 84/616 |
| 5,459,281 | 10/1995 | Shibukawa | 84/637 |

FOREIGN PATENT DOCUMENTS 61-289394 12/1986 Japan .

*Primary Examiner*—David S. Martin
*Assistant Examiner*—Marlon Fletcher
*Attorney, Agent, or Firm*—Graham & James LLP

[57] ABSTRACT

In accordance with one chord detecting approach, a peak value of the number of notes composing performance data is periodically detected for each predetermined time period and a combination of notes corresponding to the detected peak value is extracted as a representative note combination for the period, so that a chord is detected, for each of the predetermined time periods, on the basis of the extracted combination of notes. In accordance with another chord detecting approach, detection is made of a state of notes composing the performance data at each of three specific timings, i.e., predetermined beat timing, preceding timing slightly before the beat timing and succeeding timing slightly after the beat timing in an automatic accompaniment. A chord is detected on the basis of the thus-detected state of notes.

10 Claims, 12 Drawing Sheets

MUSICAL INSTRUMENT HAVING A CHORD DETECTING FUNCTION

BACKGROUND OF THE INVENTION

The present invention relates to chord detection devices which detect a chord on the basis of performance data generated in response to performance on a keyboard musical instrument or the like.

In automatic bass chord performance and other types of automatic performances, automatic accompaniment tones can be generated in accordance with chords actually performed on a keyboard. To this end, it has been conventional to detect the roots and types of performed chords. For instance, note data are input which correspond to performance data produced by manual performance (key depression) on a keyboard of an electronic musical instrument, i.e., which correspond to one or more depressed keys, and the roots and types of such performed chords are detected on the basis of combination of the input note data corresponding to the depressed keys (depressed key pattern). In accordance with a typical example of the conventionally known chord detecting approaches, each time a key depression event has occurred, detection of a chord is attempted on the basis of a combination of note data corresponding to all then-depressed keys on a chord performing keyboard. However, this prior chord detecting approach is deficient in that, even when the player believes that he could simultaneously depress plural keys for a desired chord, there would undesirably be caused an appreciable variation in the actual key depression event occurrence time and that detection noise would often result from temporary chord detection errors caused by mistouching of keys.

To solve the above-mentioned problems, another chord detecting approach is proposed, in accordance with which a particular time point when a first key depression event (new key-on event) occurs from a state where all keys are released on a chord performing keyboard is designated as a trigger point, and a chord is detected on the basis of a note data combination pattern relative to key depression events having occurred within a predetermined period of time from the trigger point. This approach can ignore variation in key depression event time and mistouched key depression within a predetermined period and hence effectively enhance the chord detection accuracy. However, with this chord detecting approach, chord detection is allowed only after all the keys have been placed in the released state. Thus, in changing chords during a performance, the player always must make a key release operation to place all the keys in the released state prior to initiating key depression for a desired chord. This would considerably limit the freedom of the chord performance operation while making the operation very troublesome and could never allow chords to be changed in a legato-like manner.

Further, Japanese Patent Laid-open Publication No. SHO 61-289394 discloses another chord detecting approach, where a chord detection operation is made, for a predetermined period (period corresponding to a sixteenth note length, for example), periodically for each predetermined beat timing of automatic performance tempo (for each quarter note timing, for example). According to the disclosed approach, if depressed key notes vary during the given period, it is permitted to make chord detection in response to the variation; otherwise, no chord detection is made at all. With this approach, because chord detection is made on the basis of combination of depressed key notes generated for a predetermined period immediately after predetermined beat timing, no chord detection error would result from mistouched keys at other times; however, if some of component keys of a preceding chord has not been completely released at the beginning of the beat timing, it is possible that misdetection of chord results.

SUMMARY OF THE INVENTION

It is therefore an object of the present invention to provide a chord detection device which, even when a chord has been performed by any optional performance operation other than a special performance operation specifically directed to chord detection, is capable of accurately detecting the performed chord on the basis of the performance data.

To achieve the above-mentioned object, a chord detection device in accordance with the present invention comprises an input section for inputting performance data including one or more notes changing with time, a detection section for, for each of predetermined time periods, detecting a peak value of the number of notes in the performance data simultaneously input via the input section, an extraction section for extracting a combination of notes corresponding to the peak value detected by the detection section for each of the predetermined time periods, as a representative note combination for the time period, and a chord detection section for, for each of the predetermined time periods, detecting a chord on the basis of the note combination extracted by the extraction section.

With the above-mentioned arrangement, a peak value of the number of notes composing performance data is periodically detected for each predetermined time period and a combination of notes corresponding to the detected peak value is extracted as a representative note combination for the period, so that a chord is detected, for each of the predetermined time periods, on the basis of the extracted combination of notes. Therefore, when the number of notes composing performance data is temporarily reduced due to mistouched input, such a performance data change is not detected as a peak value change, so that no chord detection operation corresponding thereto is performed, thus preventing misdetection of chord. In addition, when, for making chord changing performance, one or more new notes are additionally depressed with some notes maintained in the depressed state, the new depressed key state is detected as a peak value of the number of notes in the performance data. This permits accurate detection of the new (after-change) chord. Accordingly, unlike the prior art, it is not necessary to make troublesome performance operation of redepressing component notes of a desired chord after having placed all the keys in the released state. Namely, this arrangement can effectively deals with a legato-style chord changing performance operation.

Further, a musical instrument in accordance with the present invention comprises an input section for inputting performance data including one or more notes changing with time, an extraction section for extracting a state of notes composing the performance data, at each predetermined beat timing, preceding timing slightly before the beat timing and succeeding timing slightly after the beat timing in an automatic accompaniment, and a chord detection section for detecting a chord on the basis of the state of notes extracted by the extraction section.

The musical instrument thus arranged is characterized in that extraction is made the state of notes composing performance data at each of the three specific time points, i.e., predetermined beat timing, preceding timing slightly before the beat timing and succeeding timing slightly after the beat timing in an automatic accompaniment, and a chord is detected on the basis of the state of notes extracted by the extraction section. Generally, chord performance is made at each beat timing, and thus occurrence of note-designating on/off events (key depression and key release) will concentrate on the beat timing. Therefore, accurate chord detection is permitted by extracting performance data at the beat timing and detecting a chord on the basis of the thus extracted performance data. However, in actual performances, it is very rare that the beat timing perfectly coincides with the performance operation timing; performance data is input slightly after the beat timing. For this reason, the present invention is based on the beat timing and attempts to achieve accurate chord detection by extracting performance data at the beat timing and preceding and succeeding timings slightly before and after the beat timing. In particular, considering performance data at the preceding timing before the basic timing is useful in that it can appropriately deal with a legato-style chord changing performance. Namely, even when component note of a preceding (before-change) chord is left depressed at the beginning of the beat timing due to a legato-style note designating performance change, this can be accurately determined by reference to the state of notes extracted at the preceding timing.

Now, the preferred embodiments of the present invention will be described in detail below with reference to the accompanying drawings.

DETAILED DESCRIPTION OF THE PREFERRED EMBODIMENT

Figure 1:
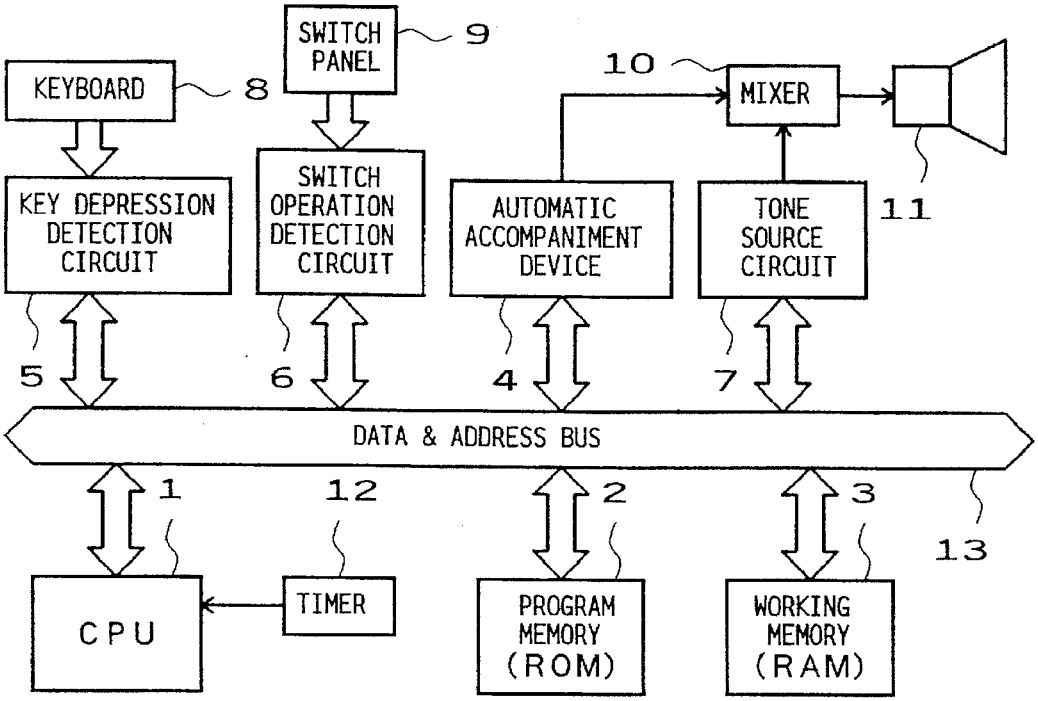
FIG. 1 is a block diagram illustrating the hardware structure of an embodiment of an electronic musical instrument which contains a chord detection device in accordance with the present invention.

FIG. 1 is a block diagram illustrating the general hardware structure of an electronic musical instrument that contains a chord detecting function provided by the present invention. The electronic musical instrument according to this embodiment performs various processes under the control of a microcomputer, which comprises a microprocessor unit (CPU) 1, a program memory (ROM) 2 and a working memory (RAM) 3. The CPU 1 controls the entire operation of the electronic musical instrument. To the CPU 1 are connected, via a data and address bus 13, the program memory 2, working memory 3, automatic performance device 4, key depression detection circuit 5, switch operation detection circuit 6 and tone source circuit 7. The program memory, which is a read-only memory (ROM), has stored therein system programs for execution by the CPU 1 and various tonal parameters and data. The working memory 3 is provided in predetermined address areas for temporarily storing various data and flags produced as the CPU 1 executes the programs.

The automatic performance device 4 contains an accompaniment pattern memory that has stored therein data indicative of the roots and types of detected chords and data relative to bass progressions. The automatic performance device 4 generates automatic performance tone signals on the basis of the above-mentioned data and in accordance with tempo clock pulses. A keyboard 8 has a plurality of keys for selecting the pitch of a tone to be generated, and key switches corresponding to the plural keys. As necessary, the keyboard 8 may also have a key touch detection means such as a key depression force detection device. Although the embodiment is described here as including the keyboard 8 since the keyboard is a fundamental music performance operator that is easy to understand, any other performance operator may of course be employed in addition to or in place of the keyboard 8.

The key depression detection circuit 5 includes key switch circuits that are provided in corresponding relation to the pitch designating keys on the keyboard 8. This key depression detection circuit 5 outputs a key-on event signal when it detects a change from a key-released state to a key-depressed state of the keyboard 8 and outputs a key-off event signal when it detects a change from a key-depressed state to a key-released state of the keyboard 8. The key depression detection circuit 5 also outputs a key code (note number) indicative of the pitch of a key whose key-on or key-off event has been detected thereby. In addition, the key depression detection circuit 5 detects a key depression speed or force to output as velocity data or after-touch data.

A switch operation detection circuit 6 is provided in corresponding relation to various operators (switches) on a switch panel 9, and it outputs, as event information, operation data corresponding to the operational state of each of the operators. Among the various operators provided on the switch panel 9 are an automatic performance start/stop switch, style selection switches and other operators for selecting, setting and controlling the tone color, pitch and volume of each tone to be generated. The style selection switches are provided for selecting one of performance styles based on various rhythms such as rock, waltz, bossa nova, march, samba and the like.

The tone source circuit 7, which is capable of simultaneously generating plural tone signals in plural channels, receives melody-performance related data that are contained in performance data given via the data and address bus 13, and the circuit 7 generates a melody related tone signal on the basis of the received data. The mixer 10 receives the melody related tone signal from the tone source circuit 7 and a chord-performance related or bass-performance related tone signal from the automatic performance device 4, so as to provide a mixed tone signal of the two received signals. The automatic accompaniment device 4 and tone source circuit 7 may employ any known tone signal generation system, such as: the memory readout system where tone waveform sample value data are sequentially read out from a waveform memory in accordance with address data that change in correspondence to the pitch of a tone to be generated; the FM system where tone waveform sample value data are obtained by performing predetermined frequency modulation operations using the above-mentioned address data as phase angle parameter data; or the AM system where tone waveform sample value data are obtained by performing predetermined amplitude modulation operations using the above-mentioned address data as phase angle parameter data. The mixed tone signal output from the mixer 10 is audibly reproduced or sounded via a digital-to-analog converter (ADC), amplifier and speaker contained within the sound system 11.

A timer 12 is provided for generating tempo clock pulses to count a predetermined time interval for later-described chord detection and also to set a tempo for an automatic performance. The frequency of the tempo clock pulses can be adjusted by a tempo switch (not shown) provided on the switch panel 9. The tempo clock pulses are given to the CPU 1 as timer interrupt instructions, upon which the CPU 1 performs various automatic accompaniment processes in a timer interrupt fashion.

Now, with reference to the flowcharts of FIGS. 2 to 4, a description will be given on example processes that are performed for chord detection by the microcomputer of the electronic musical instrument shown in FIG. 1.

Figure 3:
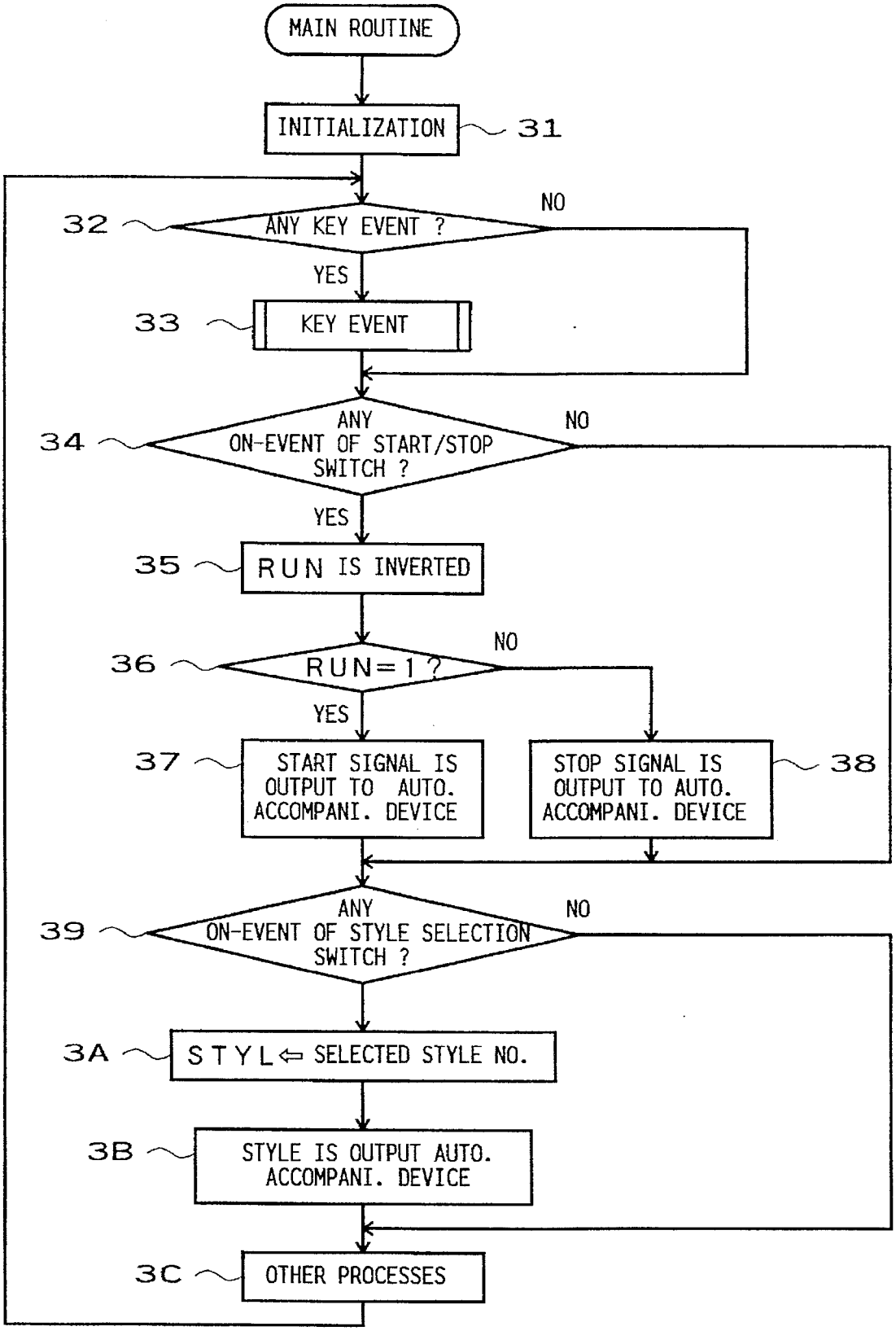
FIG. 3 is an example of a main routine performed by a microcomputer shown in FIG. 1.

FIG. 3 illustrates an example of a main routine that is performed by the microcomputer in the step following sequence.

Step 31: Upon power-on of the electronic musical instrument, the CPU 1 starts an initialization process in accordance with the control program stored in the program memory 2. In this initialization process, the CPU 1 initializes various registers and flags within the working memory 3.

Step 32: The key depression detection circuit 5 is scanned to determine whether or not any key event has occurred. The program proceeds to next step 33 if some key event has occurred (YES), but jumps to step 34 if no key event has occurred (NO).

Step 33 is performed each time a key event has occurred due to operation of the keyboard 8 and will be later described in detail in relation to FIG. 4.

Step 34: The switch operation detection circuit 6 is scanned to determine whether any on-event has occurred due to operation of the start/stop switch. The program proceeds to step 35 if such an on-event has occurred (YES), but proceeds to step 39 if no such on-event has occurred (NO).

Step 35: A performance run state flag RUN is inverted. Namely, in this embodiment, an automatic performance is started or stopped each time the start/stop switch is operated.

Step 36: It is determined whether or not the performance run state flag RUN is at "1". If the flag RUN is at "1", this means that an automatic performance is to be started, and the program proceeds to step 37. If the flag RUN is not at "1", this means that an automatic performance is to be stopped, and the program branches to step 38.

Step 37: Because the preceding step 36 has determined that the inverted performance run state flag RUN is at "1", i.e., that an automatic performance is to be started, a start signal is output to the automatic accompaniment device 4.

Step 38: Because the preceding step 36 has determined that the inverted performance run state flag RUN is at "0", i.e., that an automatic performance is to be stopped, a stop signal is output to the automatic accompaniment device 4.

Step 39: A determination is made on whether or not there is any on-event of the style selection switch on the switch panel 9. The program goes to next step 3A if there is such an on-event, but jumps to step 3C if there is no such on-event.

Step 3A: The performance style number selected by the style selection switch is stored into a style register STYL.

Step 3B: Tone colors for individual parts in the performance style stored in the style register STYL are supplied to the automatic accompaniment device 4, along with respective channel numbers for the tone colors.

Step 3C: There are performed other processes including a process based on operation of any other operator on the switch panel 9, a tone volume changing process, etc.

Figure 4:
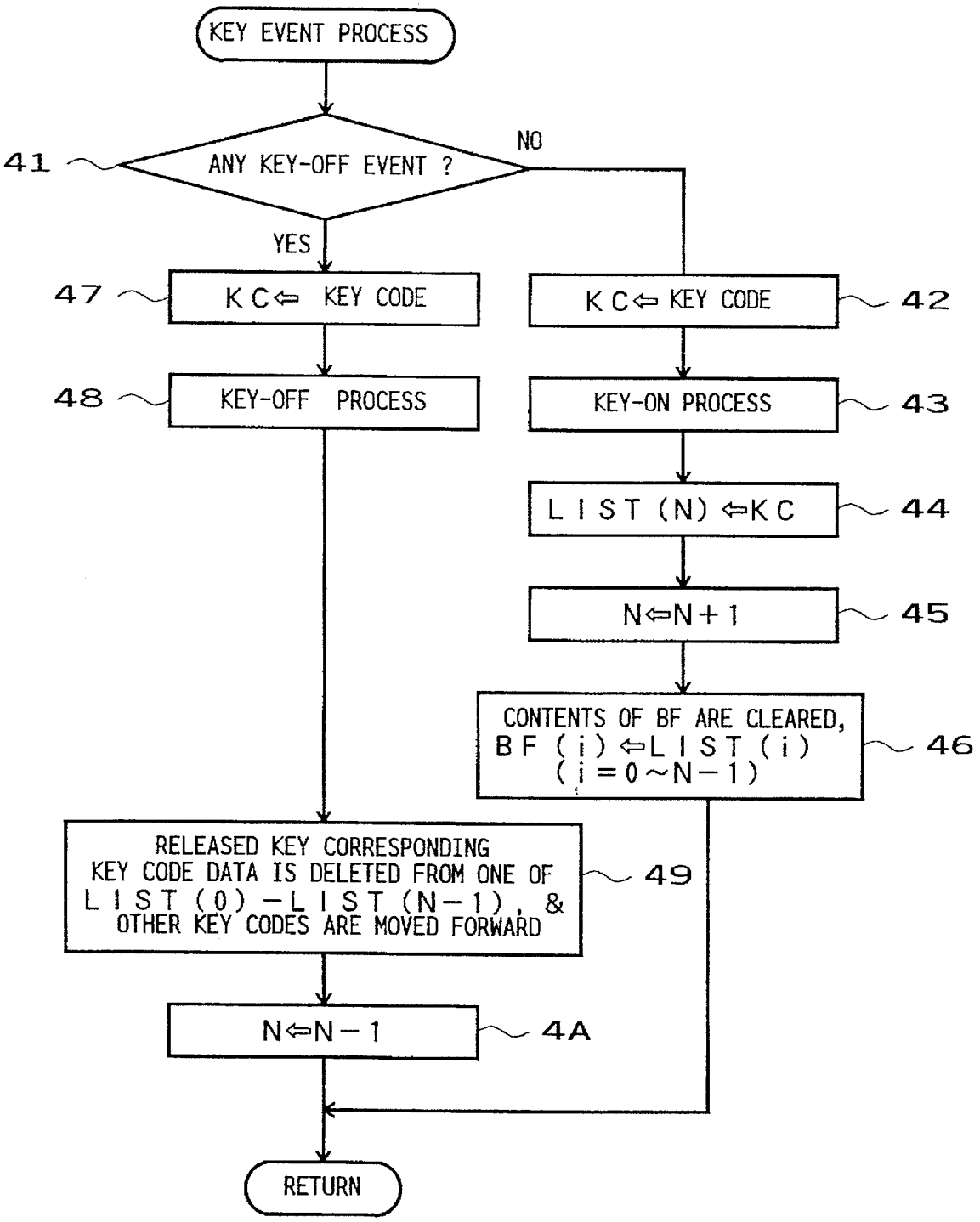
FIG. 4 is a flowchart illustrating the detail of a key event process shown in FIG. 3.

FIG. 4 illustrates an example of the key event process that is performed in step 33 by the microcomputer. This key event process is performed in the following step sequence each time a key event has occurred due to operation of the keyboard 8.

Step 41: A determination is made on whether the key event is a key-off event. If the key event is a key-off event (YES), the program goes to step 42; otherwise, the program does to step 47.

Step 42: Because the determination in the preceding step 41 indicates a key-on event, a key code corresponding to the key-on event is stored into a key code register KC.

Step 43: A tone generation process (key-on process) is performed for the key code corresponding to the key-on event.

Step 44: The key code stored in the key code register KC is stored into an Nth list register LIST (N). The value N, which is a stored value in a variable register, indicates the number of keys currently in a key-on state (i.e., currently depressed keys). Accordingly, the value N is incremented in step 45 each time a key-on event has occurred and is decremented in step 50 each time a key-off event has occurred.

Step 45: The value in the variable register N is incremented by one. This operation updates the number of currently depressed keys stored in the variable register N.

Step 46: Data in key code buffers BF are cleared, and the key codes stored in the list registers LIST (i) are stored into the key code buffers BF (i). Namely, whenever a key-on event has occurred, the data in the key code buffer are replaced with the key codes of the currently depressed keys. After that, the program returns to the main routine.

Step 47: Because the previous step 41 has determined that the key event is a key-off event, the key code corresponding to the key-off event is stored into the key code register KC.

Step 48: A tone muting process (key-off process) is performed for the key code which corresponds to the key-off event.

Step 49: The key code stored in the key code register KC in step 47 is searched for through the list registers LIST(0) to LIST (N−1) and then is deleted from the list register storing it. Then, the other key codes following the deleted key code are moved forward to fill the list register LIST emptied due to the deletion of the key code.

Step 4A: Because the key code has been deleted from the list register LIST in the preceding step 49, the value in the variable register N is decremented by one accordingly, and then the program returns to the main routine.

Figure 2:
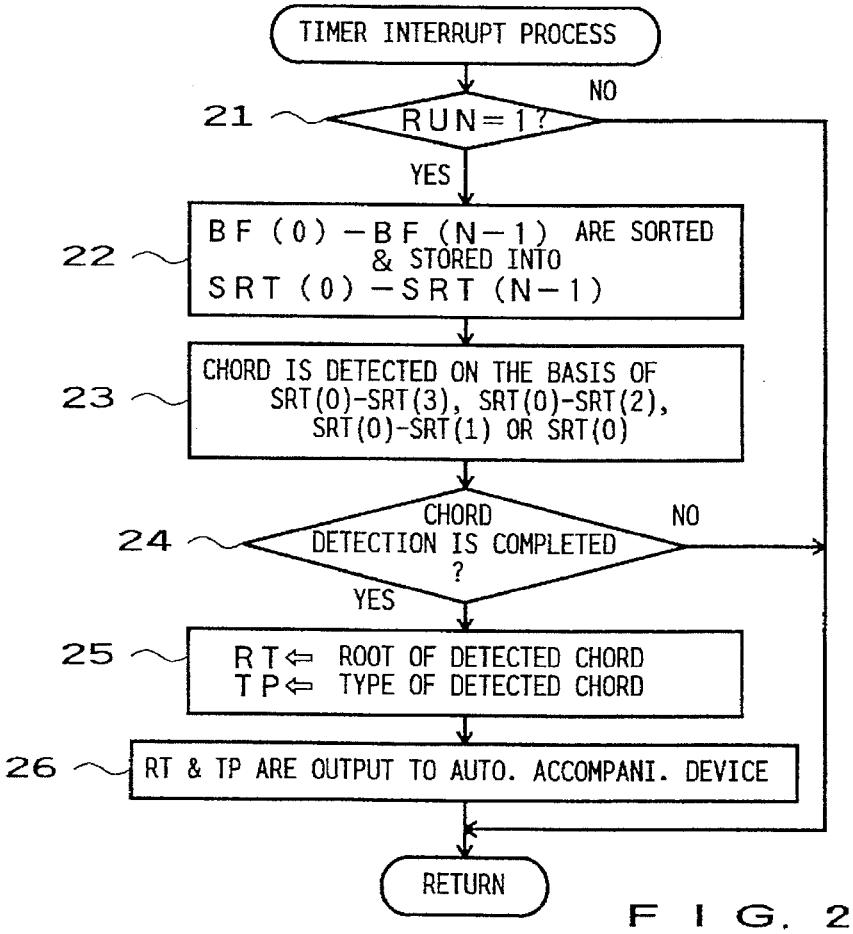
FIG. 2 is a flowchart illustrating the detail of a timer interrupt process which is performed at an interrupt frequency of 96 times per measure.

FIG. 2 illustrates a timer interrupt process that is performed, in this embodiment, at an interrupt frequency of 96 times per measure. This process controls the chord detection in the following step sequence.

Step 21: A determination is made on whether the performance run state flag RUN is at "1". If the flag RUN is at "1" (YES), i.e., if an automatic performance is to be started, the program goes to next step 22, but if not, the program returns to the main routine of FIG. 2.

Step 22: The key codes stored in the key code buffers BF(0) to BF(N−1) are sorted (rearranged) in such an order that lower pitch key codes precede higher pitch key codes. The thus sorted key codes are stored into respective sort registers SRT (0) to SRT(N−1).

Step 23: If the number of key codes stored in the key code buffers BF (i) is four, a chord detection operation is performed on the basis of four key codes stored in the sort registers SRT(0) to SRT(3). If, however, the number of key codes stored in the key code buffers BF (i) is less than four, the chord detection operation is performed on the basis of key code(s) stored in the sort register(s) SRT(0), SRT(0) and SRT(1), or SRT(0) to SRT(2). If the number of the stored key codes is two or one, a chord type is detected on the basis of a last detected chord.

Step 24: A determination is made on whether a chord detection operation has been completed, i.e., whether any chord has been detected by the preceding step 23. If the answer is in the affirmative in step 23, the program proceeds to step 25, but if not, the program returns to the main routine of FIG. 2. Namely, at times, it may not be possible to detect any chord on the basis of the key codes stored in the sort registers SRT(i), and in such a case the program returns to the main routine immediately.

Step 25: The root of the detected chord is set into a root register RT, and the type of the detected chord is set into a chord type register TP.

Step 26: The stored chord root and type in the root and type registers RT and TP are provided to the automatic accompaniment device 4, which in turn performs an accompaniment based on the detected chord.

FIGS. 5A to 5D are graphic representations explanatory of the operation of the chord detection device in accordance with this embodiment, in each of which the horizontal axis represents time and the vertical axis represents the number of depressed keys.

Figure 5A:
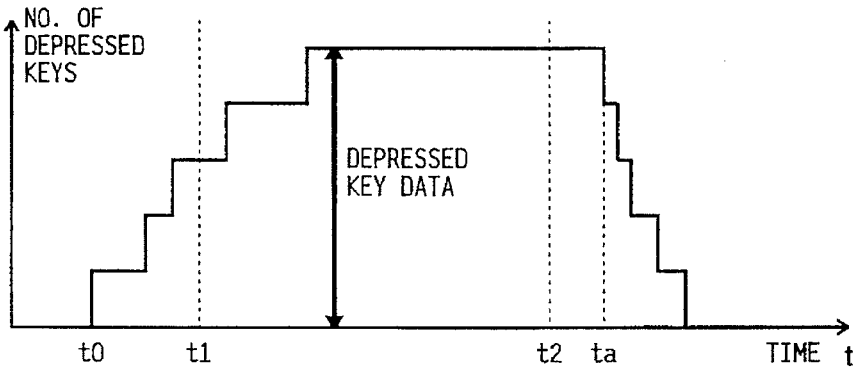
FIGS. 5A to 5D are diagrams explanatory of the operation of the chord detection device in accordance with the embodiment.
Figure 5B:
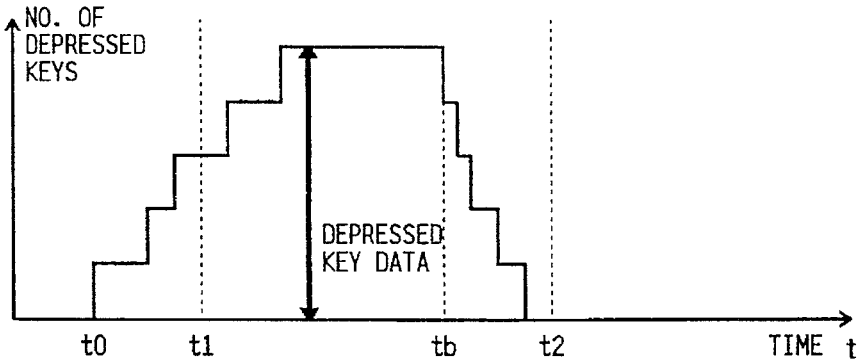
Figure 5C:
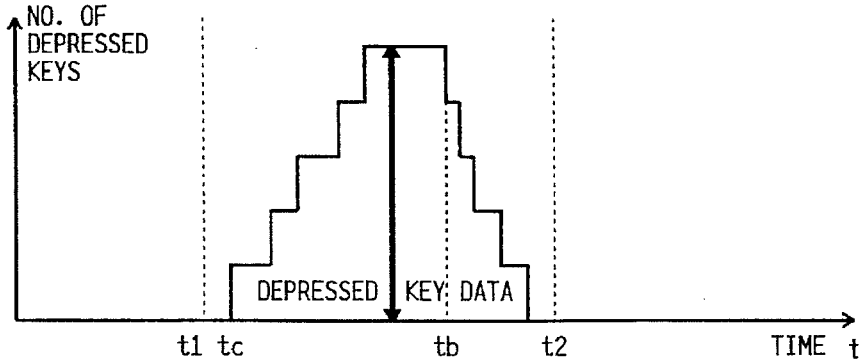
Figure 5D:
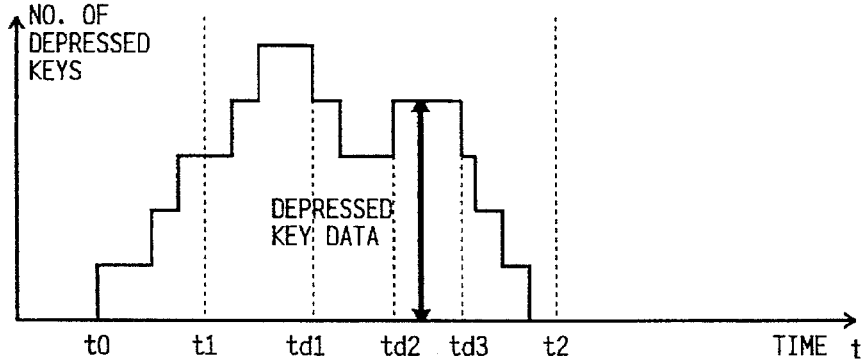

FIG. 5A shows a case where first and second detection times t1 and t2 arrive during key depression, and FIG. 5B shows a case where a first detection time t1 arrives during key depression and all the keys are released prior to a second detection time t2. FIG. 5C shows a case where key depression and key release are made between first and second detection times t1 and t2. FIG. 5D shows a case where a first detection time t1 arrives during key depression, and then key depression and key release are made between the first and second detection times t1 and t2, and where there are two peaks in the number of depressed keys between the first and second detection times t1 and t2.

First, FIG. 5A will be described in detail.

In the case as shown in FIG. 5A, key depression (key-on event) starts at time t0 prior to the first detection time t1 and then the number of depressed keys gradually increases. In response to each depressed key, the above-mentioned steps 41 to 46 of the key event process of FIG. 4 are performed so that the contents of the key code buffers BF(i) are rewritten as previously mentioned.

Once the first detection time t1 arrives during depression of a third key, the timer interrupt process of FIG. 2 is performed. Since three most recent key codes have been rewritten into the key code buffers BF(i) in response to the depression of the third key, a chord detection operation is performed, in the interrupt process of FIG. 2, on the basis of these three key codes.

Also, after the first detection time t1, steps 41 to 46 of the key event process of FIG. 4 are performed for each depressed key. In this example, five keys remain depressed. The interrupt process of FIG. 2 is also performed at the second detection time t2. At this time, five most recent key codes are rewritten into the key code buffers BF(i) in response to the fifth key depression, and thus the interrupt process of FIG. 2 detects a chord on the basis of these five key codes.

Once the key release (key-off event) is initiated at time ta, steps 47 to 4A of FIG. 4 are repetitively performed so that the key codes having been stored in the list registers LIST(i) in response to each key depression are deleted one by one until no more key code is left in the list registers LIST(i). Then, in response to each subsequent key depression (key-on event), new key codes are stored into the list registers LIST(i), and a chord detection operation is performed at each predetermined time, i.e., detection time.

Next, FIG. 5B will be described.

In the case shown in FIG. 5B, key depression (key-on event) occurs at time t0 prior to the first detection time t1 and then the number of depressed keys gradually increases. In response to each key depression, the above-mentioned steps 41 to 46 of the key event process of FIG. 4 are performed and the contents of the key code buffers BF(i) are rewritten.

Once the first detection time t1 arrives during third key depression, the interrupt process of FIG. 2 is performed in a similar manner to the case of FIG. 5A so that a chord detection operation is made on the basis of the three key codes rewritten in the key code buffers BF(i).

Also, after the first detection time t1, steps 41 to 46 of the key event process of FIG. 4 are performed for each depressed key. In this case, key release (key-off event) starts at time tb prior to the second detection time t2, and all the keys are released before the second detection time t2. In response to each key release, steps 47 to 4A of FIG. 4 are performed, so that the key codes having so far been stored in the list registers LIST(i) are deleted one by one until no more key code is left in the list registers LIST(i).

But, in this case, all the key codes which were found to be in the depressed state when the last key depression occurred between the first and second detection times t1 and t2 have already been stored in the key code buffers BF(i). Consequently, even if the interrupt process of FIG. 2 is performed at the second detection time t2, a chord detection operation is carried out on the basis of the five key codes stored in the key code buffers BF(i).

A next description will be made on FIG. 5C.

In the case shown in FIG. 5C, key depression (key-on event) occurs at time tc subsequent to the first detection time t1, and all the keys are released prior to the second detection time t2. Thus, similarly to the case shown in FIG. 5C, all the key codes which were found to be in the depressed state when the last key depression occurred have already been stored in the key code buffers BF(i). Consequently, even if the interrupt process of FIG. 2 is performed at the second detection time t2, a chord detection operation is carried out on the basis of the five key codes stored in the key code buffers BF(i).

Next, FIG. 5D will be described.

In the case shown in FIG. 5D, key depression (key-on event) occurs at time t0 prior to the first detection time t1 and the number of depressed keys gradually increases afterwards. In response to each key depression, the above-mentioned steps 41 to 46 of the key event process of FIG. 4 are performed, and the contents of the key code buffers BF(i) are rewritten or updated.

Once the first detection time t1 arrives during third key depression, the interrupt process of FIG. 2 is performed in a similar manner to the case shown in FIG. 5A. Three most recent key codes are rewritten into the key code buffers BF(i), and a chord detection operation is performed on the basis of these three key codes stored in the key code buffers BF(i).

In this case, key release (key-off event) occurs twice after time td1, in response to which steps 47 to 4A of FIG. 4 are carried out twice so that the key codes corresponding to the two released keys are deleted from the list registers LIST(i).

Then, other key depression occurs at time td2, and thus steps 42 to 46 of FIG. 4 are performed again in such a manner that four most recent key codes are stored into the key code buffers BF(i).

After that, another series of key release operations begins again and all the keys are released prior to the second detection time t2. Consequently, steps 47 to 4A of FIG. 4 are performed after time td3 in such a manner that all the key codes corresponding to the released keys are cleared from the list registers LIST(i) and no more data is left in the list registers LIST(i) at the second detection time t2.

Namely, in this case, the contents of the key code buffers BF(i) are updated in accordance with the depressed keys at time td2, and thus key codes corresponding to the most recent peak in the number of depressed keys are stored into the key code buffers BF(i). Then, the interrupt process of FIG. 2 is performed at the second detection time t2 so as to detect a chord on the basis of the four key codes stored in the key code buffers BF(i).

The preferred embodiment has been described above in relation to such a case where a chord detection is performed with respect to all key events without determining an area on the keyboard. Alternatively, the embodiment may also be applied to a case where the keyboard 8 is divided into right and left keyboard areas. In such a case, a performance operation on the right keyboard area may be considered as corresponding to a melody performance so that tones of corresponding pitches are controlled without detecting a chord. A performance operation on the left keyboard area may be considered as corresponding to a chord performance so that a chord is detected on the basis of corresponding performance data.

Further, although the preferred embodiment has been described above as being applied to an electronic musical instrument, the embodiment is of course also applicable to any other instruments where a sequencer module for performing automatic accompaniment processing is provided separately from a tone source module comprised of a key depression detection circuit and a tone source circuit, and where data are exchanged between the individual modules via the well-known MIDI protocol.

Moreover, the above-described preferred embodiment is designed to perform a chord detection even when a detection time has arrived during a key depression. However, when a detection time has arrived during a key depression, a chord detection may be performed with respect to the depressed keys only if a time during which the key depression state remains unchanged is more than a predetermined time length, e.g., a fourth of the detection time interval. By so doing, in the case of FIG. 5A, a chord detection is deferred until the second detection time t2 with no chord detection performed at the first detection time t1, to thereby prevent a chord from being detected in the course of a key depression.

For instance, when keys of "C", "E", "G" and "B" are depressed in the mentioned order and a chord detection is performed on the first three depressed keys, i.e., "C", "E" and "G", the chord will be determined wrongly as "C major" and it is difficult to provide accurate chord detection. However, by examining whether or not a time during which the key depression state remains unchanged is more than a predetermined time length, chord detection will be performed at the next detection time, and consequently the chord will be determined accurately as "C seventh" on the basis of the depressed key codes "C", "E", "G" and "B".

Furthermore, although the preferred embodiment as described above performs chord detection on the basis of key depression data corresponding to the last peak number of depressed keys if there are two or more peaks, it is also possible to detect a chord on the basis of key depression data corresponding to a peak having a longest peak duration within a predetermined time range. Namely, in the above-described embodiment, when a plurality of local peak values is detected for any of the predetermined time periods, a combination of notes corresponding to the last detected local peak value is extracted as a representative note combination for the time period, and chord detection is made on the basis of the extracted combination of note. Alternatively, when a plurality of local peak values is detected for any of the predetermined time periods, a combination of notes corresponding to one of the local peak values which has a longest duration may be extracted as a representative note combination for the time period, and chord detection may be made on the basis of the extracted combination.

Moreover, chord detection may be attempted for individual peaks in such a manner that a successfully detected chord or a chord allotted higher priority is determined as a detected chord. Namely, when a plurality of local peak values is detected for any of the predetermined time periods, examination is made, for each of combinations of notes corresponding to the respective local peaks, as to whether or not a chord is formed by the combination and the combination of notes corresponding to only one of the local peaks for which a chord is formed is extracted as a representative note combination for the time period. In such a case, if chords are formed respectively by the combinations of notes corresponding to two or more peaks, only one of the combinations is selected in accordance with a predetermined priority rule and the selected combination is extracted as a representative note combination for the time period, to detect a chord corresponding thereto.

Now, a description will be given on another embodiment of the present invention.

Figure 6:
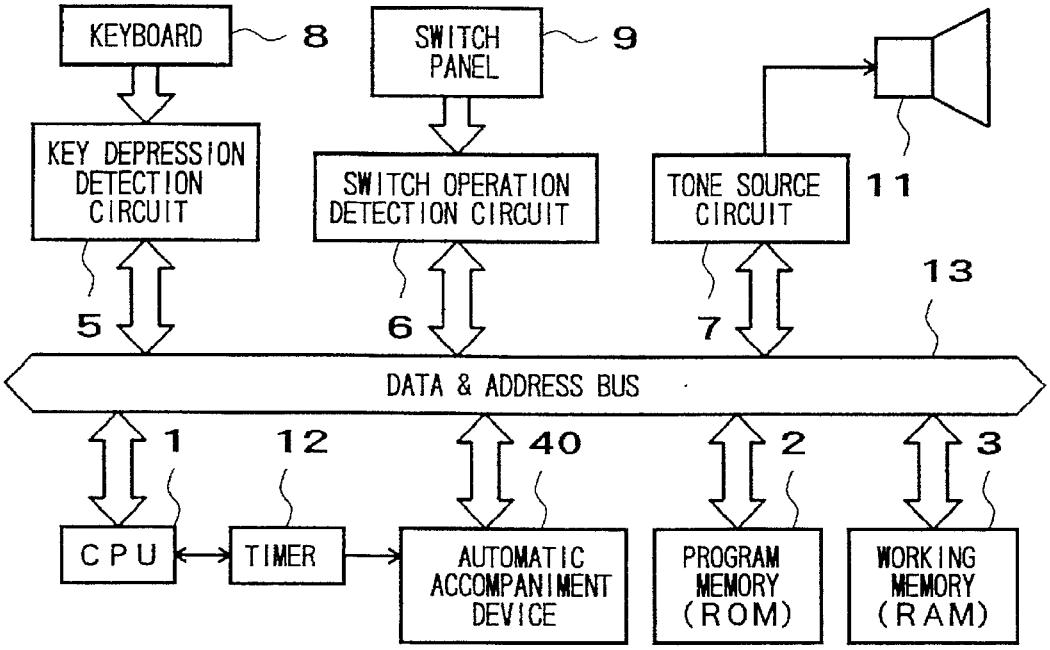
FIG. 6 is a block diagram illustrating the hardware structure of another embodiment of an electronic musical instrument containing the chord detecting function of the present invention.

The hardware structure of the embodiment shown in FIG. 6 is essentially similar to that shown in FIG. 1. However, an automatic accompaniment device 40, which is provided with no tone source function, is designed to supply, in correspondence to timing to generate accompaniment tones, accompaniment tone generation instruction data to a tone source circuit 7 via a bus 13, so that the tone source circuit 7 generates sound signals for not only melody sounds but also accompaniment sounds. Further, a timer 12 can directly interrupt the automatic accompaniment device 40.

With reference to FIGS. 7 to 9 and FIGS. 11 to 14, various processes will be described by way of example which are performed by a microcomputer of the electronic musical instrument shown in FIG. 6.

Figure 7:
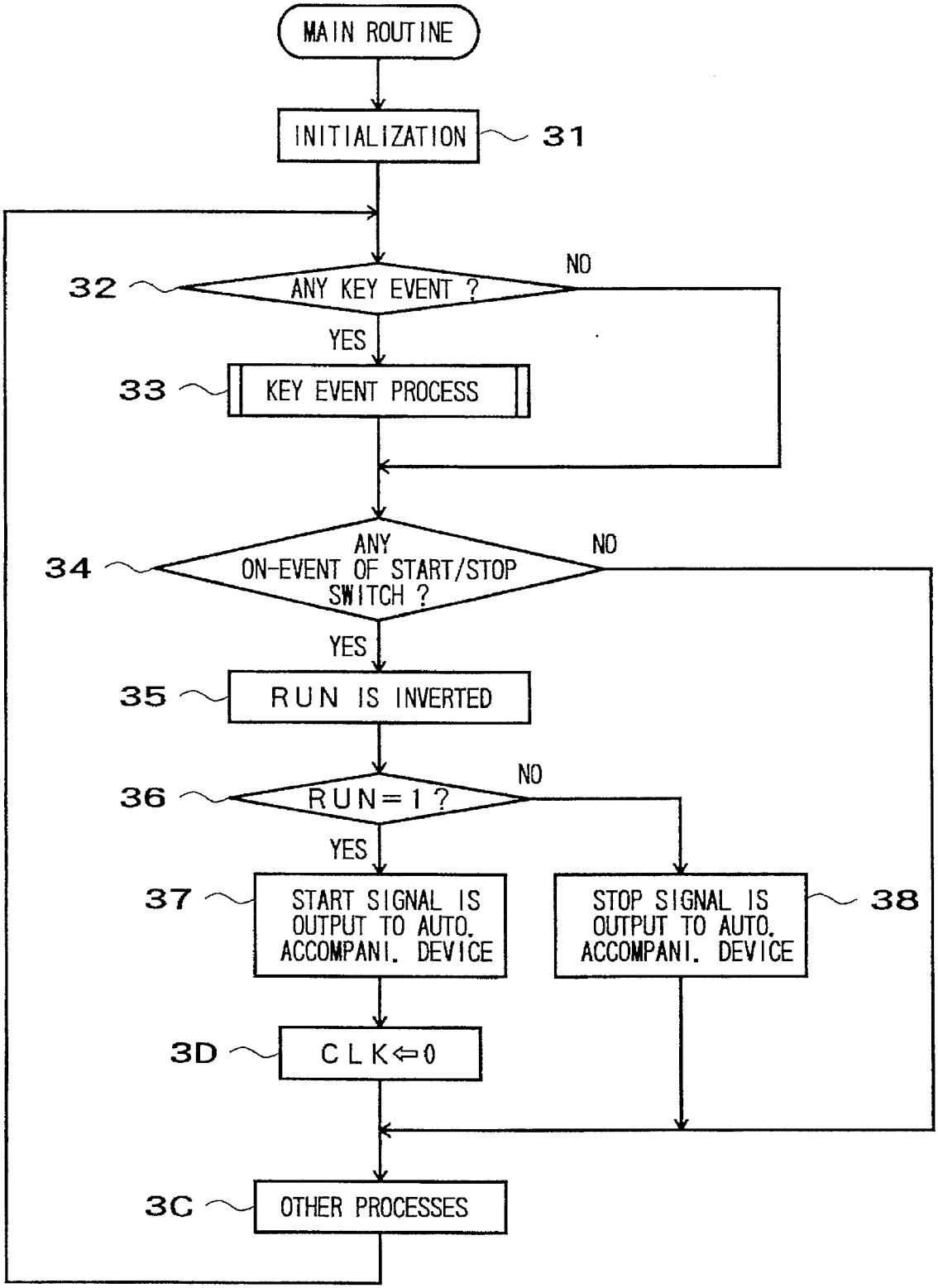
FIG. 7 is a flowchart illustrating an example of a main routine that is performed by a microcomputer of the electronic musical instrument of FIG. 6.

FIG. 7 is a flowchart illustrating an example of a main routine performed by the microcomputer of the musical instrument of FIG. 6, in which steps 31 to 38 are similar to those steps denoted in FIG. 3 by the same reference characters. In FIG. 7, after step 37, the program goes to step 3D in order to reset a tempo clock register CLK to "0"in readiness for newly starting an automatic accompaniment, and then the program goes to step 3C to perform other processing.

Figure 8:
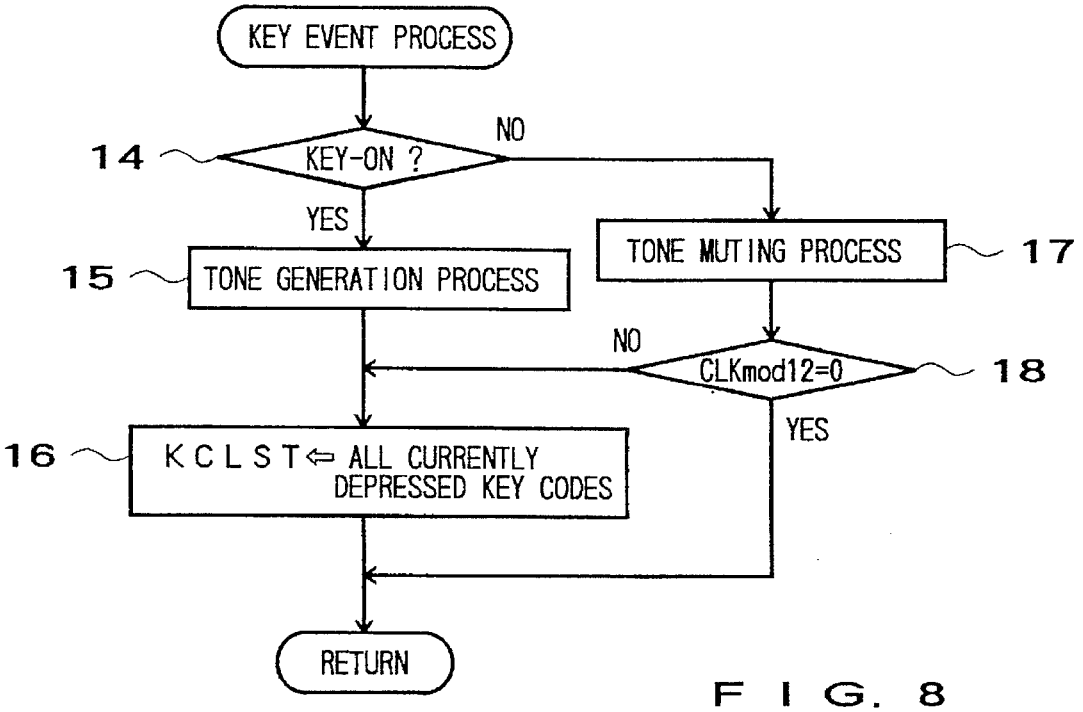
FIG. 8 is a flowchart illustrating an example of a key event process in the main routine of FIG. 7.

FIG. 8 is a flowchart illustrating an example of a key event process that is carried out by the microcomputer in step 33 of the main routine of FIG. 7. This key event process is performed in the following sequence each time a key event occurs due to performance operation of the keyboard 28.

Step 14: A determination is made on whether the key event is a key-on event. An affirmative determination causes the program to proceed to step 15, but a negative determination causes the program to branch to step 17.

Step 15: Because the key event has been determined to be a key-on event in the previous step 14, a tone generation (key-on) process is performed for a key code corresponding to the key-on event.

Step 16: The key codes of all the keys being currently depressed are stored into the key code list register KCLST.

Step 17: Because of the determination in the previous step 14 that the key event is a key-off event, a tone generation termination (key-off) process is performed for a key code corresponding to the key-off event.

Step 18: It is determined whether the remainder obtained from dividing the stored value in the tempo clock register CLK by 12 is "0"or not. If the remainder is "0"(YES), the program returns to the main routine of FIG. 3, but if the remainder is other than "0", the program goes to step 16.

In this example, it is assumed that one measure corresponds to 96 tempo clock pulses, a quarter note corresponds to 24 tempo clock pulses and an eighth note corresponds to 12 tempo clock pulses. The tempo clock register CLK accumulatively stores values from "0" to "95", so that, if the remainder obtained by dividing the stored value in the tempo clock register CLK by the length of eighth note, "12" (CLKmod12) is "0", this signifies that the current timing is exactly a tone generation timing, i.e., beat timing of eighth note.

Namely, in this key event process, when a key-on event has occurred, the key code corresponding to the key-on event is stored into the key code list register KCLST, and when a key-off event has occurred, the key code corresponding to the key-off event is cleared from the key code list register KCLST. However, in the case of a key-off event occurring before the remainder left after dividing the stored value in the tempo clock register CLK by 12 (CLKmod12) becomes from "0" to "1", the program returns to the main routine without deleting from the key code list register KCLST the key code corresponding to the key-off event. Because of this arrangement, all the key codes of keys that are in the depressed state during the time when the remainder CLKmod12 becomes from "0" to "1" will be stored into the key code list register KCLST.

Figure 10:
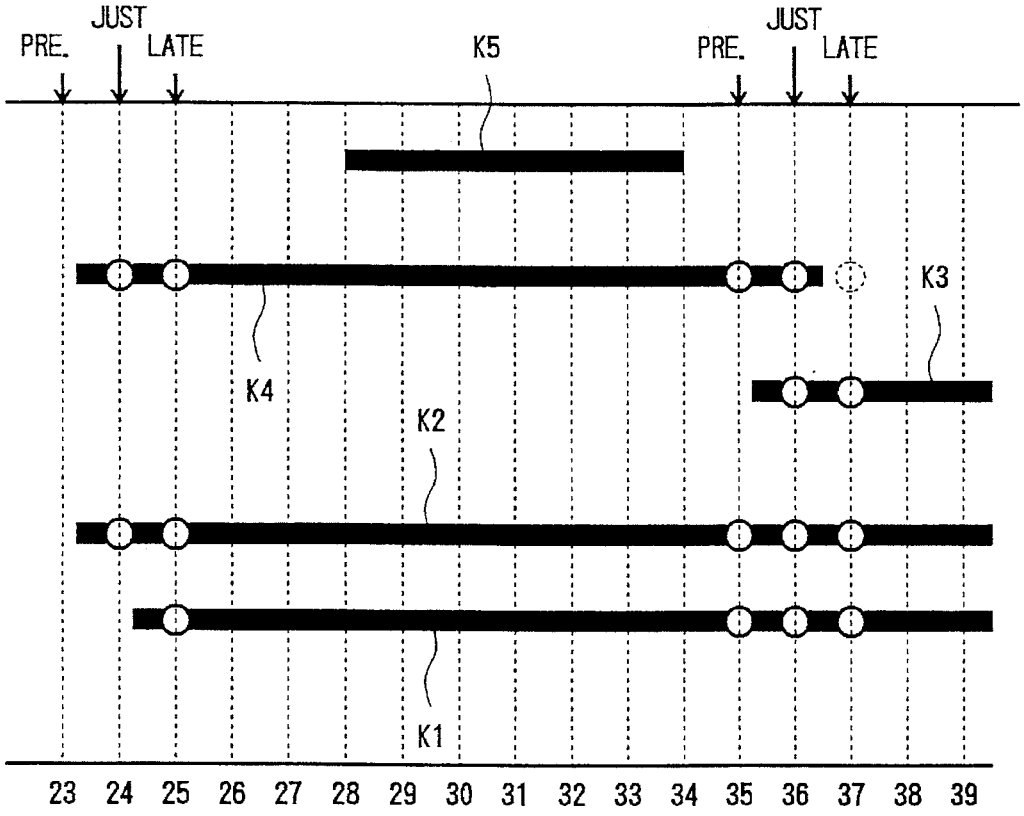
FIG. 10 is a diagram explanatory of the operation of a chord detection process and a legato process that are performed in the timer interrupt process of FIG. 9.
Figure 9:
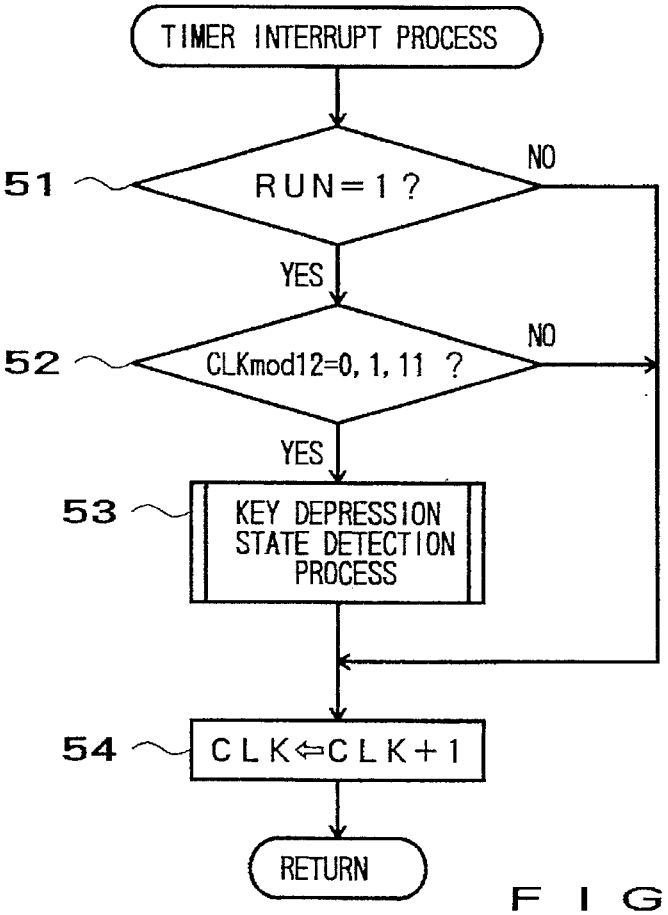
FIG. 9 is a flowchart illustrating the detail of a timer interrupt process which is performed at an interrupt frequency of 96 times per measure.
Figure 10:
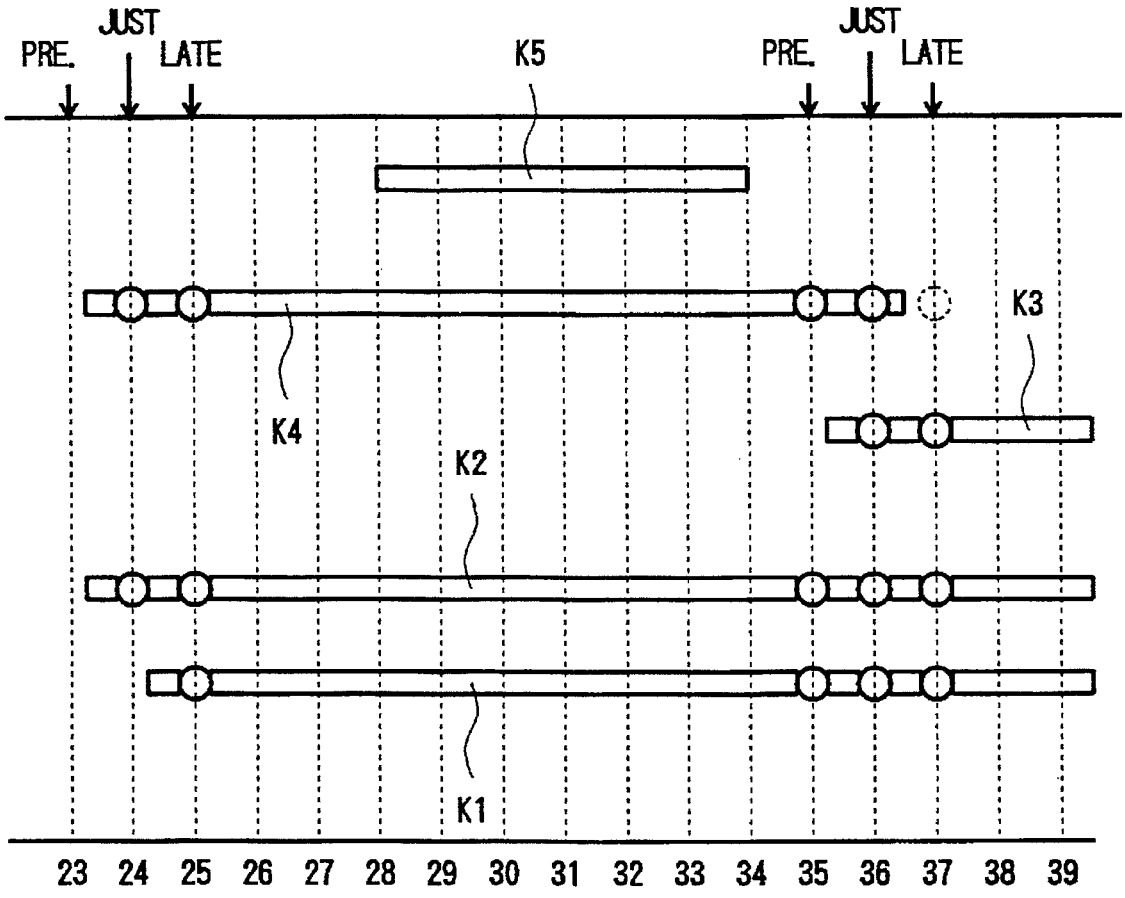

FIG. 9 illustrates a timer interrupt process that is performed at an interrupt frequency of 96 times per measure, and FIG. 10 is explanatory of a chord detection process and a legato process that are performed by the timer interrupt process of FIG. 9.

In FIG. 10, the horizontal axis represents the lapse of time, and the vertical axis represents a key depression state at the individual time points. The timer interrupt process of FIG. 9 is performed 96 times per measure as earlier mentioned, and in this connection, values (23 to 39) stored in the tempo clock register CLK are shown, on the lower end of FIG. 10, to indicate individual current interrupt time points.

Further, the time interrupt process also detects a key depression state within one unit time length before and after each eighth-note timing, to thereby detect a chord. In this connection, on the upper end of FIG. 10, there are shown pre-timing PRE indicating that the remainder left after dividing the value in the tempo clock register CLK by 12 (CLKmod12) is "11", Just timing JUST indicating that the remainder is "0" and late timing LATE indicating that the remainder is "1".

In FIG. 10, the key of key code K1 is depressed between interrupt time points 24 and 25 and then released between interrupt time points 39 and 40. The key of key code K2 is depressed between interrupt time points 23 and 24 and then released between interrupt time points 39 and 40. The key of key code K3 is depressed between interrupt time points 35 and 36 and then released between interrupt time points 39 and 40. The key of key code K4 is depressed between interrupt time points 23 and 24 and then released between interrupt time points 36 and 37. The key of key code K5 is depressed at interrupt time point 28 and then released at interrupt time point 34.

The timer interrupt process of FIG. 9 is carried out in the following step sequence.

Step 51: A determination is made on whether the performance run state flag RUN is at "1". If the flag RUN is at "1" (YES), i.e., if an automatic performance is to be initiated, the program goes to step 52. If the determination is in the negative, i.e., if an automatic performance is to be stopped, the program jumps to step 54.

Step 52: It is determined whether the remainder resultant from division of the value in the tempo clock register CLK by 12 (CLKmod12) is "11", "0" or "1". If the answer is in the affirmative, the program proceeds to next step 53, but if the remainder is other than "11", "0" and "1", the program Jumps to step 54.

Step 53: Because of the determination in the previous step 52 that the remainder is (CLKmod12) is one of "11", "0" and "1", a key depression state detection process is performed for detecting respective key depression states at the pre-timing PRE (interrupt time points 23 and 35), just timing JUST (interrupt time points 24 and 36) and late timing LATE (interrupt time points 25 and 37). The detail of this key depression state detection process will be described later.

Step 54: The program returns to the main routine after incrementing the value in the tempo clock register CLK by one. This increments the interrupt time point by one.

Figure 11:
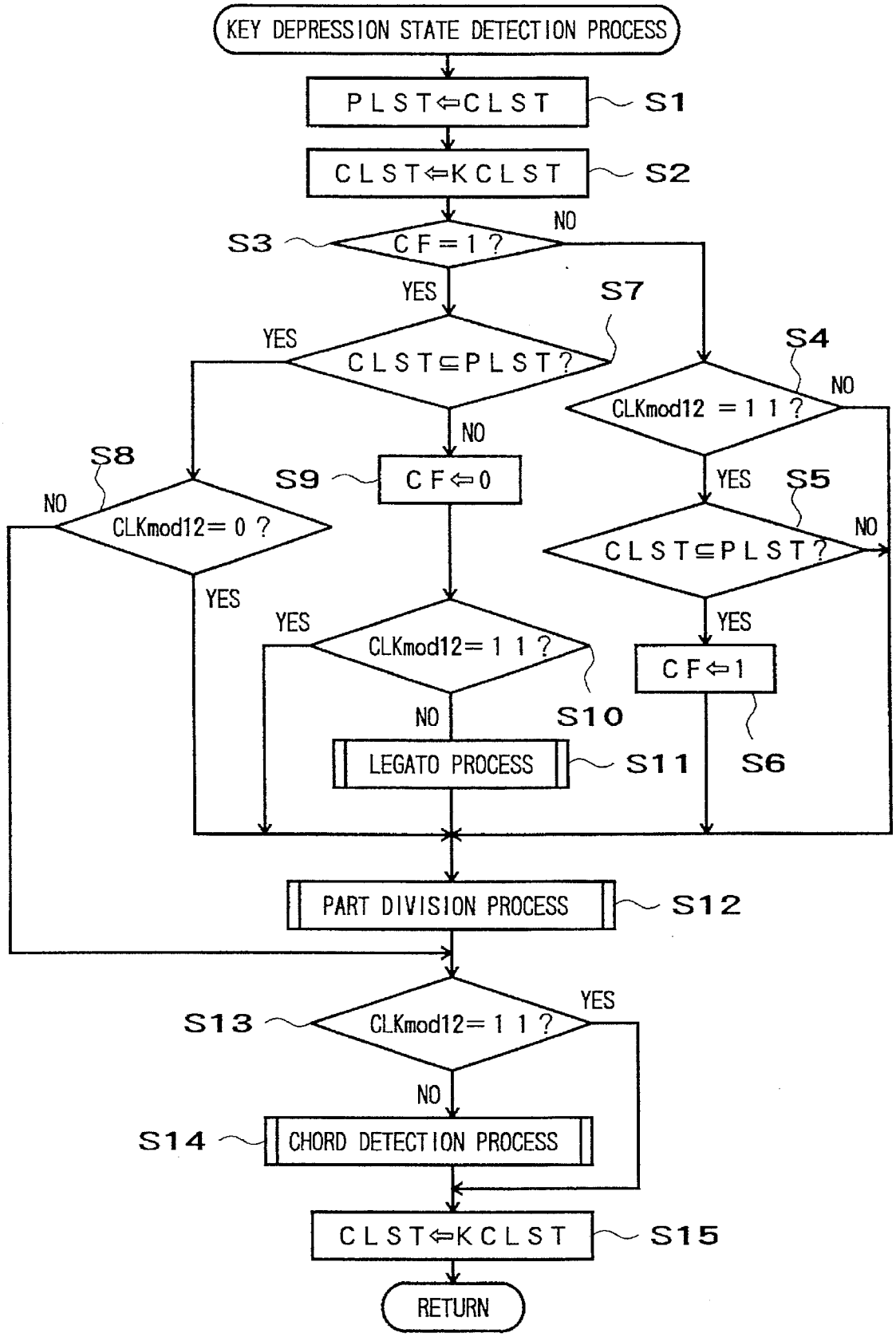
FIG. 11 is a flowchart illustrating a detailed example of a key depression state detection process that is performed in the timer interrupt process of FIG. 9.

FIG. 11 illustrates the detail of the key depression state detection process of FIG. 9, which, as previously mentioned, is performed in the following step sequence when the remainder resultant from division of the stored value in the tempo clock register CLK by 12 (CLKmod12) is one of "11" (pre-timing PRE), "0" (just timing JUST) and "1" (late timing LATE).

Step S1: Key code stored in a current list register CLST is set into a pre-list register PLST.

Step S2: Key code stored in the key code list register KCLST is set into the current list register CLST.

Through the operations of steps S1 and S2, a key code at the last interrupt time point is stored into the pre-list register PLST, and all key codes being currently depressed are are stored into the current list register CLST. As previously mentioned in relation to step 18 of FIG. 8, any key-off event is ignored which occurs before the remainder resultant from dividing the stored value in the tempo clock register CLK by 12 (CLKmod12) becomes from "0" to "1". Thus, during this period, only key-on event is treated as being valid, so that key code corresponding to the key-on event is additionally stored into the key code list register KCLST. In FIG. 10, this is exemplified by such a key state that the key of key code K4 is released between interrupt time points 36 and 37 and the key of key code K3 is depressed between interrupt time points 35 and 36.

Step S3: A determination is made on whether or not a continuation flag CF is "0". If the flag CF is at "1" (YES), the program proceeds to step S7, but if not, the program branches to step S4. The continuation flag CF is set to "1" in step S6 when determination results of steps S4 and S5 are both "YES" and is set to "0" when a determination result of step S7 is "NO". In the example of FIG. 10, the determination result of step S3 will be "YES" at interrupt time point 36 and will be "NO" at other interrupt time points 23, 24, 35 and 37.

Step S4: Because the previous step S13 has determined that no key depression is in progress, a further determination is made in this step on whether the remainder resultant from division of the stored value in the tempo clock register CLK by 12 (CLKmod12) is "11" (pre-timing PRE). If answered in the affirmative, the program goes to step S5, but if not, the program jumps to step 1C. In the example of FIG. 10, the determination result of step S4 will be "YES" at interrupt time points 23 and 35 and will be "NO" at other interrupt time points 24, 35 and 37.

Step S5: Because of the determination in step S4 that the current interrupt time point is pre-timing PRE, key code at the last late timing LATE has been set into the pre-list register PLST in step S1, and key code at the current pre-timing PRE has been set into the current list register CLST in step S2. Thus, a determination is made in this step S5 on whether all the key codes in the current list register CLST belong to those in the pre-list register PLST. If the determination in step 15 is in the affirmative, i.e., if the key depression has continuity, the program goes to next step S6, but if the key depression has no continuity, the program Jumps to step S12.

Namely, if all the key codes stored in the current list register CLST belong to those stored in the pre-list register PLST, this means that the key depression state at the last late timing LATE still continues at the current pre-timing PRE, but if not, this means that new key release or new key depression has taken place. For instance, in the example of FIG. 6, there are stored key codes K1, K2 and K4 at both interrupt time points 25 (late timing LATE) and interrupt timing 35 (pre-timing PRE), it is determined in step S5 that the key depression state has continuity. Therefore, in the example of FIG. 10, a determination in step S5 becomes affirmative for interrupt time points 35 and becomes negative at the other time points.

Step S6: The determination in step S4 that the current interrupt time point is pre-timing PRE and subsequent determination in step S15 that all the key codes stored in the current list register CLST belong to those stored in the pre-list register PLST, together means that there is continuity between the key depression states at the current late timing LATE and current pre-timing PRE. Thus, in this step S6, the program goes to step 1C after having set the continuity flag CF to "1". Therefore, in the example of FIG. 10, "1" is set into the continuity flag CF at interrupt time point 35.

Step S7: Since it has been determined in the previous step S3 that the continuity flag CF is at "1", i.e., the key depression is in progress, this step S7 determines whether all the key codes stored in the current list register CLST belong to those stored in the pre-list register PLST. If answered in the affirmative, the program proceeds to step S8, but if not, the program proceeds to step S9. That is, because the previous step S3 has determined that the key depression state is in progress, this step determines whether the key depression still continues at a period between the last and current key depression states.

If all the key codes stored in the current list register CLST belong to those stored in the pre-list register PLST, this means that the key depression at the last pre-timing PRE still continues at the current just timing JUST, or that the key depression at the last just timing still continues at the current late timing LATE or is terminated at a period between the two timing JUST and PRE. Conversely, if all the key codes stored in the current list register CLST do not belong to those stored in the pre-list register PLST, this means that new key depression has been added between the last pre-timing PRE and the current Just timing JUST, or that new key depression has been added between the last just timing JUST and the current late timing LATE. This implies that there has been a change in the depressed keys in a legato style and typically corresponds to such a case where a key has been additionally depressed with certain three keys remaining depressed. In this case, it is predicted that one of the three depressed keys will be released in the considerably near future. Thus, with the legato style key change, there will occur an instant when, in changing chord designating keys, keys of a preceding chord and a new chord are depressed in a partly overlapping manner. In the example of FIG. 10, determination in step S7 becomes negative for time point 36 and it is presumed that there has occurred a legato-style chord change.

Step S8: Because step S3 has determined that the key depression is in progress and step S7 has determined that the key depression is still now in progress, this step further determines whether or not the remainder resultant from division of the value in the tempo clock register CLK by 12 (CLKmod12) is "0", i.e., whether or not the current interrupt time point is just timing JUST. If the remainder is "0" (YES) meaning that the current interrupt time point is just timing JUST, the program goes to step S12 to carry out a part division process. If the remainder is not "0" (NO) meaning that the current interrupt timing is pre-timing PRE or late timing LATE, the program jumps to step S13.

Step S9: Because step S7 has determined that all the key codes stored in the current list register CLST do not correspond to those in the pre-list register PLST (NO), this means that new key depression has taken place between the last and current timings, and this step resets the continuity flag CF to "0". Accordingly, in the example of FIG. 10, the continuity flag CF is reset to "0" at interrupt time point 36.

Step S10: A determination is made on whether or not the remainder resultant from division of the value in the tempo clock register CLK by 12 (CLKmod12) is "11", i.e., whether or not the current interrupt time point is pre-timing PRE. If the remainder is "11" (YES), the program proceeds to step S12, but if the remainder is "0" or "1" (NO), the program proceeds to step S11. In the example of FIG. 10, the determination in step S10 becomes "NO" (just timing) for time point 36.

Figure 14:
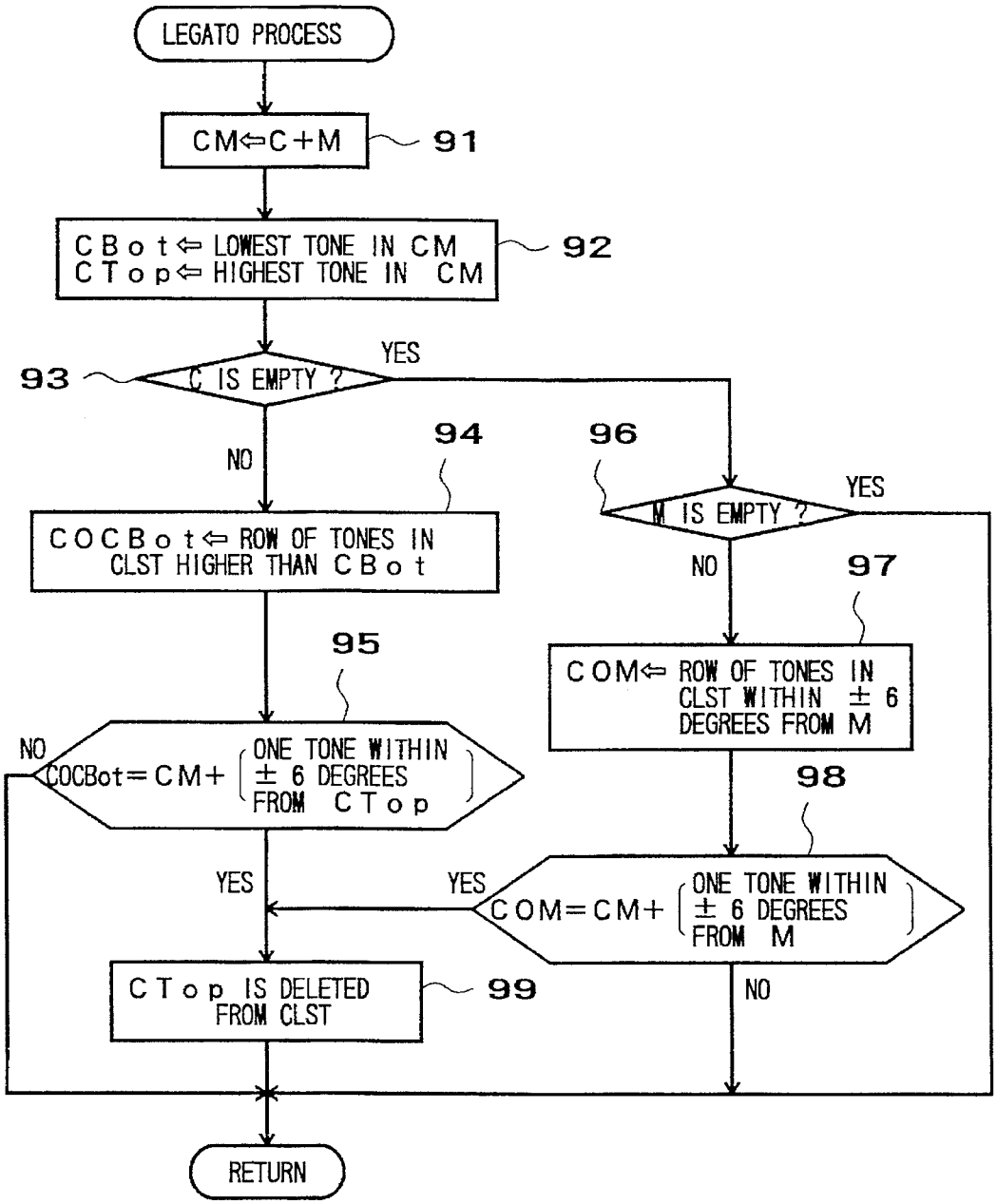
FIG. 14 is a detailed example of a legato process performed in the timer interrupt process of FIG. 9.

Step S11: A legato process is performed since it has been determined that the key depression is in progress with new key additionally depressed and the current interrupt time point is just timing JUST or late timing LATE. After "YES" routine in steps S4 and S5, the program leads to this "legato process" step S11 by way of "NO" routine in step S3 and "NO" routine in step S7. Namely, on the basis of the presumption that there has been a legato-style depressed key change, the program leads to this step S11 to perform a detailed legato determination operation. The detail of the lagato process is illustrated in FIG. 14.

Step S12: A part division process is performed to divide the key codes in the current list register CLST into predetermined parts, as will be described in detail later with reference to FIG. 12.

Step S13: A determination is made on whether or not the remainder resultant from division of the value in the tempo clock register CLK by 12 (CLKmod12) is "11". If the remainder is not "11" (N)), then the program proceeds to next step S14 to detect a chord. If the remainder is "11" (YES), it is not necessary to detect a chord and thus the program jumps to step S15.

Step S14: A chord detection process is performed on the basis of the key codes divided into the respective parts in the previous step S12. This chord detection process will be described in detail later with respect to FIG. 13.

Step S15: Since it is likely that the contents of the current list register CLST have been changed by the legato process in the previous step S11, key code in the key code list register KCLST is restored into the current list register CLST, in a similar manner to the above-mentioned step 12.

Figure 12:
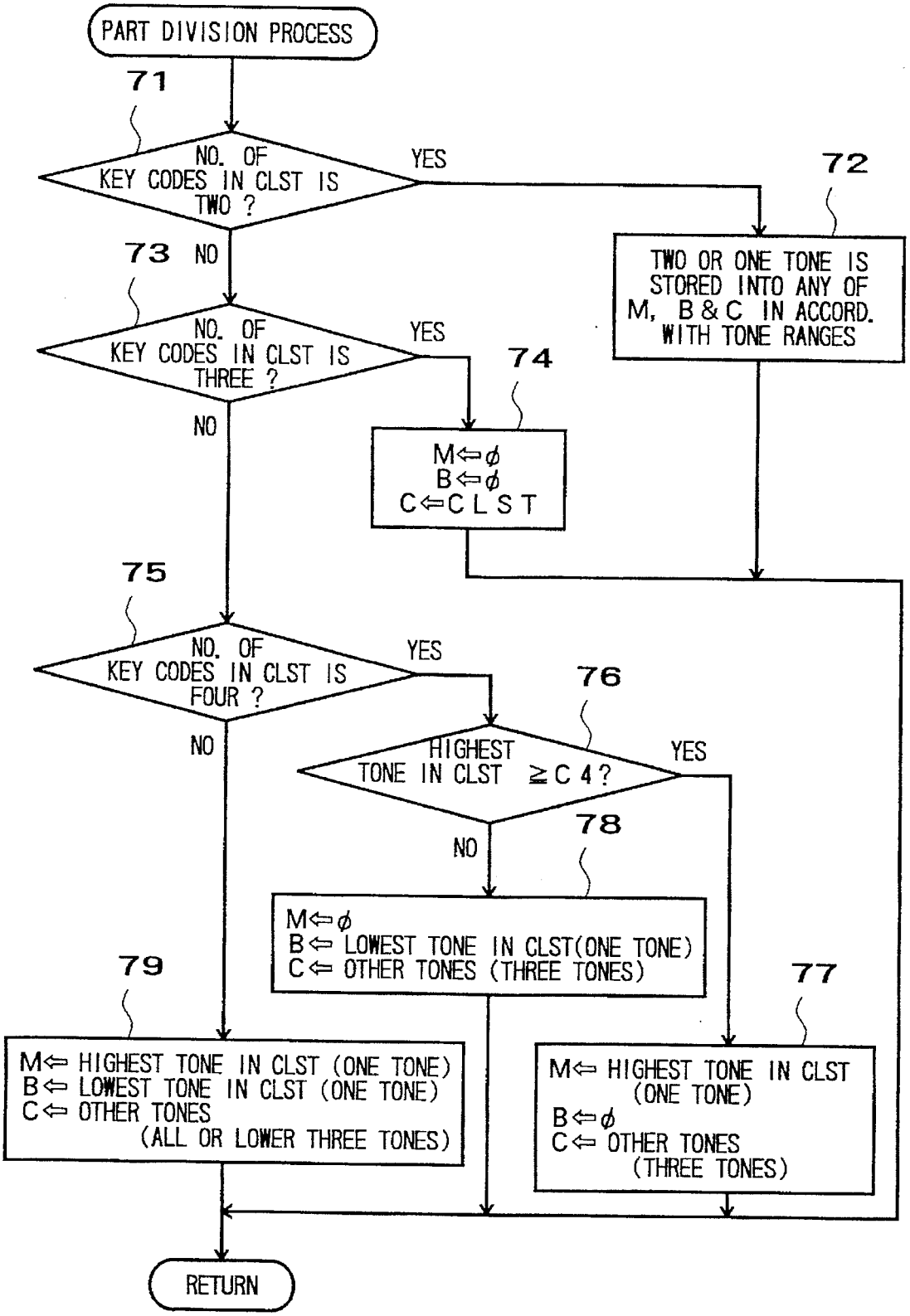
FIG. 12 is a flowchart illustrating a detailed example of a part division process performed in the timer interrupt process of FIG. 9.

FIG. 12 shows the detail of the part division process performed in step S12 of FIG. 11. This part division process divides the key codes stored in the current list register CLST into respective parts (melody part, bass part and chord part) and is performed in the following step sequence.

Step 71: It is determined whether the number of key codes stored in the current list register CLST is two or less. If the number is two or less (YES), the program goes to step 72, but if the number is more than two (NO), the program goes to step 72.

Step 72: Since the preceding step 71 has determined that the number of key codes stored in the current list register CLST is two or less, the stored key codes are sorted into the respective parts (melody part, bass part and chord part) in accordance with tone ranges to which the key codes belong (it is assumed here that the keyboard is divided into three tone ranges, of which the higher tone range is the melody part, the intermediate tone range is the chord part and the lower tone range is the bass part), and two or one key code is stored into any of the melody part register M, bass part register B and chord part register C.

Step 73: A determination is made on whether the number of key codes is three. If the number is three (YES), the program goes to step 74, but if the number is more than three, the program goes to step 75.

Step 74: Since the preceding step 73 has determined that the number of key codes stored in the current list register CLST is three, it is assumed that the stored key codes correspond to the chord part, so that empty set $\phi$ is stored into each of the melody part and bass part registers M and B and the three key codes in the current list register CLST are stored into the chord register C.

Step 75: A determination is made on whether the number of key codes stored in the current list register CLST is four. If the number is four (YES), the program goes to step 76, but if the number is more than four (NO), the program goes to step 79.

Step 76: Because the preceding step 75 has determined that the number of key codes stored in the current list register CLST, it is further determined whether a highest-pitched-tone key code in the current list register CLST represents a pitch that is equivalent to or higher than key code number C4. With an affirmative determination, the program proceeds to step 77, but with a negative determination, the program proceeds to step 77.

Step 77: Because the preceding step 76 has determined that the highest-pitched-tone key code represents a pitch equivalent to higher than key code number C4, the highest-pitched tone (single tone) is stored into the melody part register M, the remaining three tones are stored into the chord part register C, and empty set $\phi$ is stored into the bass part register B. Step 78: Because the preceding step 76 has determined that the lowest-pitched-tone key code represents a pitch lower than key code number C4, the lowest-pitch tone (single tone) is stored into the bass part register B, the remaining three tones are stored into the chord part register C, and empty set $\phi$ is stored into the melody part register M.

Step 79: Because the preceding step 75 has determined that the number of key codes stored in the current list register CLST, a highest-pitched-tone (single tone) key code in the register CLST is stored into the melody part register M, a lowest-pitched-tone (single tone) key code is stored into the bass part register B, and the key codes of all or lower three of the other tones than the highest-pitched and lowest-pitched tones are stored into the chord part register C.

Figure 13:
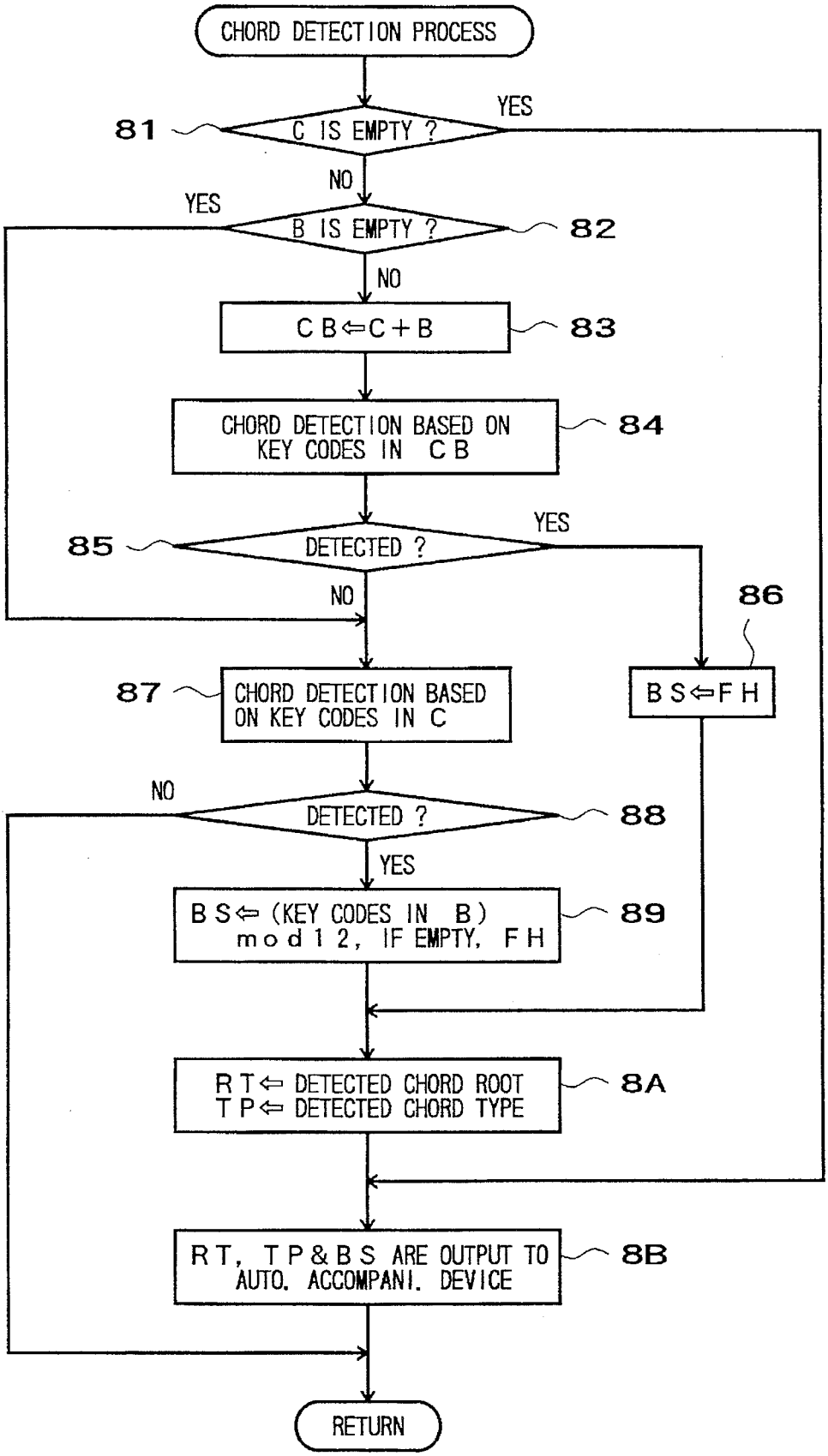
FIG. 13 is a flowchart illustrating a detailed example of a chord detection process performed in the timer interrupt process of FIG. 9.

FIG. 13 shows the detail of the chord detection process performed in step S14 of FIG. 11. In the following step sequence, this chord detection process is carried out on the basis of the key codes in the chord part and bass part registers C and C sorted in the part division process of FIG. 12.

Step 81: A determination is made on whether empty set $\phi$ is stored in the chord part register C, i.e., whether the register C is empty. If the chord part register C is empty (YES), the program jumps to step 8B, if not, the program goes to step 82.

Step 82: It is determined whether the bass part register B is empty. With an affirmative determination, the program jumps to step 87, but with a negative determination, the program goes to step 83.

Step 83: Because the preceding steps 81 and 83 have determined that both the chord part register C and the bass part register B are not empty, the key codes in the chord part register C and bass part register B are stored into a chord/bass register CB.

Step 84: Chord detection is made on the basis of the key codes stored in the chord/bass register CB.

Step 85: It is further determined whether the preceding step 84 has successfully detected any chord. If answered in the affirmative, the program proceeds to step 86, but if answered in the negative, the program proceeds to step 87.

Step 86: Hexadecimal "F" (expressed as "FH" in the figure) representing "empty code ϕ" is stored into the bass register BS.

Step 87: Because it has been determined that, although some key code is stored in the chord part register C, the bass part register B is empty, or that no chord has been successfully detected on the basis of the key codes stored in the chord/bass register CB, chord detection is made on the basis of the key codes in the chord part register C.

Step 88: It is examined whether any chord has been successfully detected in the preceding step 87. If answered in the affirmative, the program proceeds to step 89, but if not, the program reenters step S15 of the main routine shown in FIG. 11.

Step 89: Because the previous step 87 has successfully detected a chord, the remainder resultant from division of the key codes in the bass register BS by 12, i.e., pitch name is stored into the bass register BS. If, however, the bass part register B is empty, hexadecimal "F" (expressed as "FH" in the figure) indicative of "empty set ϕ" is stored into the bass part register BS.

Step 8A: The root of the detected chord is stored into a root register RT, and the type of the detected chord is stored into a chord type register TP.

Step 8B: The root and type respectively stored in the registers RT and TP and associated bass tone are provided to an automatic accompaniment device 40. Thus, the automatic accompaniment device 40 performs an accompaniment based on the detected chord. If, however, the stored value in the bass register BS is "FH", the automatic accompaniment device 40 performs an accompaniment by generating, on its own, bass tone corresponding to the detected chord.

FIG. 14 shows the detail of the legato process performed in step S11 of FIG. 11. This legato process is carried out, in the following step sequence, on the basis of the key codes dividedly stored in the chord part and melody part registers C and M, respectively, in the part division process of FIG. 12. In the example of FIG. 10, this legato process is performed at interrupt time point 36.

Step 91: The key codes in the chord part register C and melody part register M are stored into a chord melody register CM.

Step 92: A lowest-pitched-tone key code and a highest-pitched-tone key code of those stored in the chord melody register CM is stored into a chord bottom register CBot and a chord top register CTop.

Step 93: A determination is made on whether or not the chord part register C is empty. With an affirmative determination, the program proceeds to step 94, but with a negative determination, the program proceeds to step 96.

Step 94: Of those key codes stored in the current list register CLST, a row of tones (key codes) of pitch higher than the key code stored in the bottom register CBot is stored into a current overlap code register COCBot.

Step 95: It is determined whether or not the set of key codes stored in the current overlap code register COCBot (which indicates the key depression state at the current interrupt time point) is coincident with the set of the key code stored in the chord melody register CM (which indicates the key depression state at the preceding interrupt time point) and one of notes (key codes) having an interval within ±6 degrees from the note of the key code stored in the chord top register CTop (which corresponds to the highest-pitched depressed key at the preceding interrupt time point). This determination is performed on individual combinations of all notes (e.g., ten notes) having pitches within ±6 degrees from the CTop. If there is at least one coincident set, a "YES" determination is obtained, which causes the program to proceeds to step 99. With no coincident set, a "NO" determination is obtained, and then the program reenters step S12 of FIG. 11. If there has been a legato-style key depression operation, the determination in step 95 becomes affirmative, and thus the program proceeds to step 99. Namely, this represents such a state where the same keys as in the key depression state at the preceding interrupt time point are maintained in the depressed state and a new key (note having a certain interval with respect to the CTop) has been additionally depressed.

Step 96: Because the previous step 93 has determined that the chord part register C is empty, this step further determines whether the melody part register M is empty. If the melody part register M is empty, this means that there has been no key depression corresponding to the melody and chord parts, and thus the program returns to step S12 of FIG. 11. If, however, the melody part register M is not empty, the program proceeds to step 96 provided that there has been some key depression corresponding to the melody part.

Step 97: Of those key codes stored in the current list register CLST, a row of tones (key codes) within ±6 degrees from the key code in the melody part register M is stored into the current overlap melody register COM.

Step 98: It is determined whether or not the set of key codes stored in the current overlap melody register COM (which indicates the key depression state at the current interrupt time point) is coincident with the set of the key code stored in the chord melody register CM (which indicates the key depression state of the current interrupt time point) and one of notes (key codes) having an interval within ±6 degrees from any one note (key code) stored in the melody part register M. If answered in the affirmative, i.e., if the key depression state represents a legato state, the program proceeds to step 99. But, if answered in the negative, i.e., if the key depression state does not represent a legato state, the program reenters step S12 of FIG. 11.

In step 99, the CTop key code is deleted from the current list register CLST. This presumes, from the legato-style depressed key change, that the CTop key code will be turned off sooner or later and then eliminates it from among the key codes used in the subsequent "chord detection process (step S14).

Although the embodiment has been described above as being applied to an electronic musical instrument, the present invention is of course also applicable to such a tone generation device in which a sequencer module for performing an automatic accompaniment is provided separately from a tone source module comprised of a key depression detection circuit and a tone source circuit and in which data are exchanged between the modules via MIDI protocols.

Further, in the above-described embodiment, even when some key-off event occurs between just timing JUST and late timing LATE, key code corresponding to the key-off event is not cleared or deleted from the key code list register KCLST. The same operation may also take place when a key-off event occurs between pre-timing PRE and late timing LATE.

Moreover, although the above embodiment has been described in connection with a case where the part division process of FIG. 12 and the chord detection process of FIG. 13 are performed at the same frequency, the part division process may be performed more finely, i.e., at a higher frequency than the chord division process. Namely, the chord detection process may be performed at a frequency corresponding to an eighth note length, and the part division process may be performed at a frequency corresponding to a thirty-second note length.

As apparent from the above description, the present invention achieves the advantageous result that it is allowed to accurately detect a chord on the basis of performance data produced in a normal performance state without requiring execution of performance specifically intended for chord detection.

What is claimed is:

1. A chord detection device comprising input means for inputting performance data including one or more notes changing with time:

detection means for detecting a peak value of the number of notes in the performance data simultaneously input via said input means for a predetermined time period;

extraction means for extracting a combination of notes corresponding to the peak value of the number of notes detected by said detection means for each said predetermined time period, as a representative note combination for the time period; and chord detection means for detecting a chord on the basis of the note combination extracted by said extraction means for the predetermined time period.

2. A chord detection device as in claim 1, wherein said predetermined time period is set periodically in accordance with predetermined reference time signals.

3. A chord detection device as in claim 1, wherein said detecting means detects a plurality of local peak values during each predetermined time period, and wherein said extraction means extracts, as a representative note combination for said predetermined time period, a combination of notes corresponding to a local peak value last detected by said detection means.

4. A chord detection device as in claim 1, wherein said detecting means detects a plurality of local peak values during a predetermined time period, and wherein said extraction means extracts, as a representative note combination for the predetermined time period, a combination of notes corresponding to the local peak value having a longest duration.

5. A chord detection device as in claim 1, wherein said detecting means detects a plurality of local peak values during a predetermined time period, and wherein said extraction means examines, for each combination of notes corresponding to the respective local peak values, whether or not a chord is formed by the combination and extracts, as a representative note combination for the predetermined time period, the combination of notes corresponding to the local peak value which forms a chord.

6. A chord detection device as in claim 1, wherein said detecting means detects a plurality of local peak values during the predetermined time period, and wherein said extraction means examines, for each combination of notes corresponding to the respective local peak values, whether a chord is formed by the combination of notes, and if chords are formed respectively by the combinations of notes corresponding to two or more of the local peak values, said extraction means selects only one of the two or more combinations of notes in accordance with a predetermined priority rule and extracts the selected combination of notes as a representative note combination for the predetermined time period.

7. A musical instrument comprising:

input means for inputting performance data including one or more notes changing with time;

extraction means for extracting a status of notes composing the performance data at each predetermined beat timing, at a predetermined time preceding the beat timing and at a predetermined time succeeding the beat timing in an automatic accompaniment; and chord detection means for detecting a chord on the basis of the status of notes extracted by said extraction means.

8. A musical instrument as in claim 7, wherein said extraction means includes comparison means for comparing the status of notes composing the performance data at two adjacent timings, and means for determining, on the basis of said comparison, that a change in the performance data has been made in a legato style.

9. A musical instrument as in claim 8 which further comprises means for deleting a specific note from among the notes composing the performance data when it is determined that a change in the performance data has been made in a legato style, and wherein said chord detection means detects a chord on the basis of remaining notes composing the performance.

10. A musical instrument as in claim 7, wherein, when an off-event of a specific note so far input is detected between the predetermined beat timing and at the predetermined time succeeding the predetermined beat timing, said extraction means extracts the specific note without responding to the off-event and adds said specific note to notes used by said chord detection means for detecting a chord.

* * * * *